US005764597A

United States Patent [19]

Shih

[11] Patent Number: 5,764,597

[45] Date of Patent: Jun. 9, 1998

[54] ELECTRONIC CALENDAR

[76] Inventor: Wu Yung Shih, P.O. BOX 82-144., Taipei, Taiwan

[21] Appl. No.: 843,612

[22] Filed: Apr. 10, 1997

[51] Int. Cl.[6] ..... G04B 19/24; G04B 23/02

[52] U.S. Cl. ..... 368/29; 368/73; 368/82

[58] Field of Search ..... 368/10, 28, 29, 368/82–84, 223; 366/705.08

[56] References Cited

U.S. PATENT DOCUMENTS 5,344,325 9/1994 Wang ..... 368/16

5,654,940 8/1997 Wei ..... 368/28

*Primary Examiner*—Vit W. Miska

*Attorney, Agent, or Firm*—A & J

[57] ABSTRACT

An electronic calendar for finding out the corresponding Lunar Calendar date from Gregorian Calendar/National Calendar of R.O.C. date includes a display screen for displaying the date in two different calendar systems at the same time. The display screen contains one set of display units for displaying National Calendar of R.O.C/Gregorian Calendar date, one set of display units for displaying Lunar Calendar date, one set of display units for displaying hour and minute, and one set of display units for displaying the day of the week. A central processor unit and a timing control circuit are used to perform the conversion between Lunar Calendar date and Gregorian Calendar/National Calendar of R.O.C. date, and supplies display information to the display units. A keypad consists of multiple keys, the keys are used for entering the date for conversion to the other calendar system. The entered date and the converted date will be displayed on the same display screen at the same time.

3 Claims, 6 Drawing Sheets

ELECTRONIC CALENDAR

BACKGROUND OF THE INVENTION

1. Field of the Invention

This invention is related to an electronic calendar for conversion between National Calendar of R.O.C. (Republic of China)/Gregorian and Chinese Lunar Calendars.

2. Description of the Prior Art

So far, the Chinese Lunar Calendar is still in use by a lot of Chinese. It is because the Chinese seasonal events and customs defined in the Chinese Lunar Calendar are well received by the Chinese. Most of the important worship dates for Chinese are based on the Chinese lunar calendar. However, the electronic calendar available on the market only provides the information of the current date, and no additional function is provided, i.e. no conversion between the Chinese Lunar Calendar and National Calendar of R.O.C./Gregorian calendar. Furthermore, such electronic calendar suffers from the following drawbacks:

1. It cannot display both the Chinese lunar calendar and National Calendar of R.O.C./Gregorian Calendar on the screen at the same time.
2. It cannot be used to find out the corresponding National Calendar of R.O.C/Gregorian Calendar date and Chinese Lunar Calendar date in the past or future.
3. It cannot be programmed to notify the users of the arrival of the date for worshipping gods, ancestors, or other activities in the Chinese Lunar Calendar date.

Therefore, it is an object of the present invention to provide an improved electronic calendar which can obviate and mitigate the above-mentioned drawbacks.

SUMMARY OF THE INVENTION

This invention relates to an electronic calendar which consists of a display screen for displaying National Calendar of R.O.C./Gregorian Calendar date and the Chinese Lunar Calendar date. The screen always displays the date of the Chinese Lunar Calendar and date of the National Calendar of R.O.C./Gregorian Calendar. The user of this electronic calendar can enter the past or future date to the calendar and the entered date and the corresponding Chinese Lunar Calendar or National Calendar of R.O.C./Gregorian Calendar will be displayed on the display screen instantly.

The primary object of this invention is to provide an electronic calendar which will display both the Chinese lunar Calendar and National Calendar of R.O.C./Gregorian calendar on the same screen. The content of the screen consists of year, month, date, day of the week, hour and minute display units. Users can use the keys of a keypad to enter the National Calender of R.O.C./Gregorian Calendar or the Chinese Lunar Calendar date, and the corresponding Chinese Lunar Calendar date or National Calendar of R.O.C./Gregorian Calendar and the entered date will be displayed on the same display screen instantly.

Another object of this invention is to provide a notification feature for the user, whereby the user can pre-set a future date in either National Calendar of R.O.C./Gregorian Calendar or the Chinese Lunar Calendar date. The electronic calendar will send out voice information to notify the user of the arrival of the pre-set important date, so that the user will not forget the important date or activity.

DETAILED DESCRIPTION OF THE PREFERRED EMBODIMENT

Figure 1:
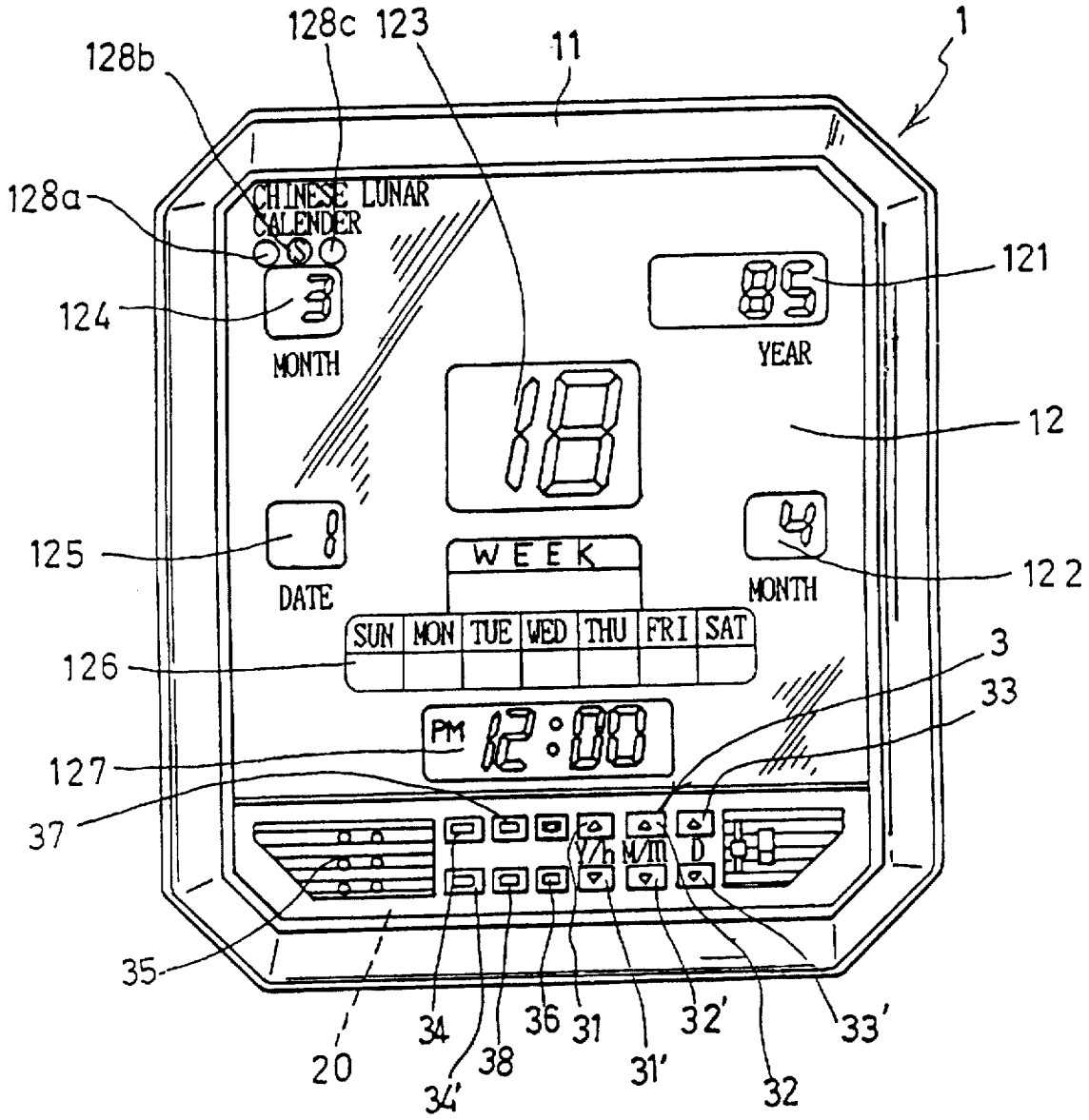
FIG. 1 illustrates the National Calendar of R.O.C./Gregorian Calendar date and its corresponding Chinese Lunar Calendar date shown on the display screen of the electronic calendar according to the present invention, wherein the Chinese Lunar Calendar date is the first day of the third month of the year and this month is a short month represented by S (29 days per month)
Figure 2:
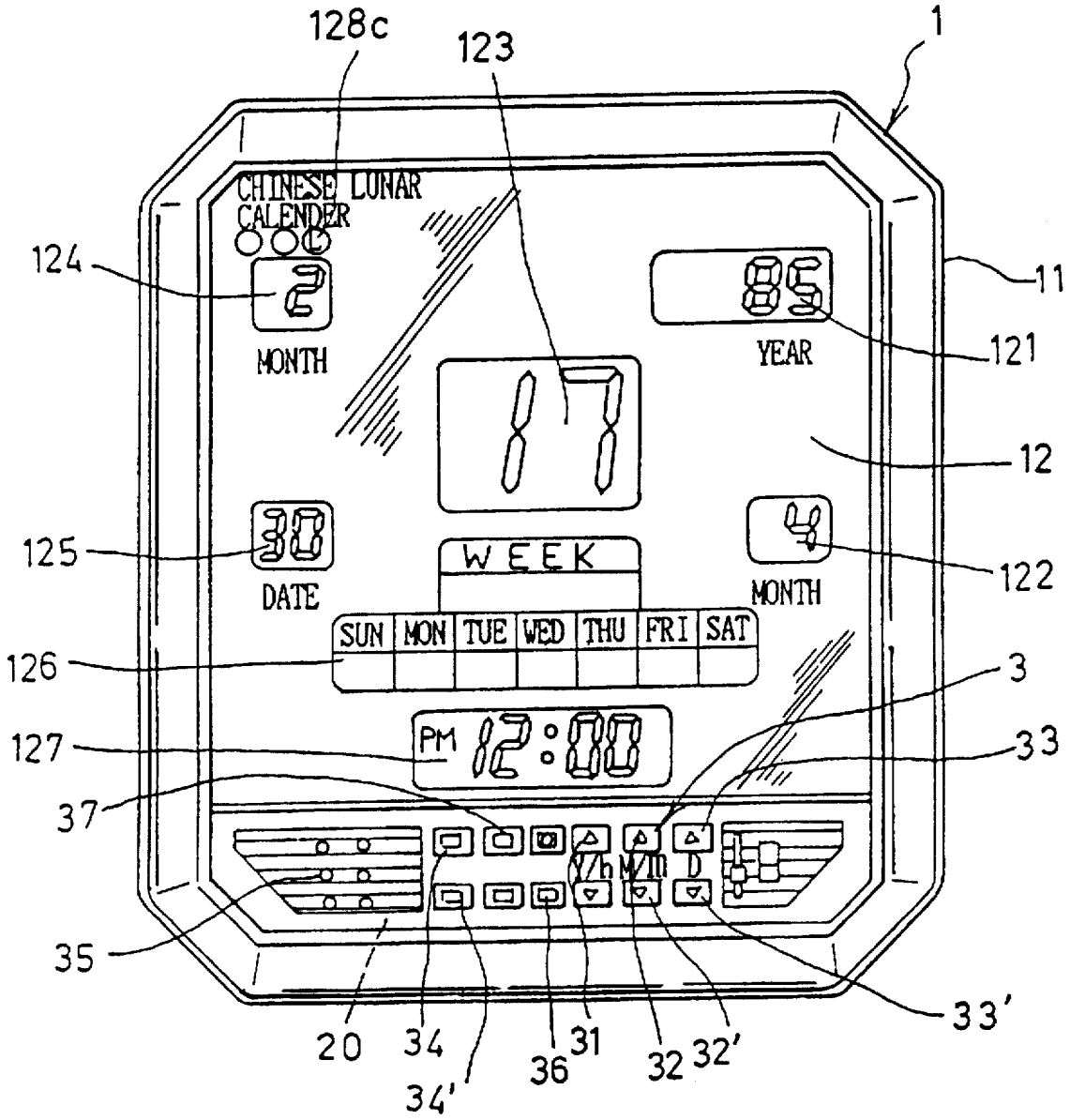
FIG. 2 illustrates the National Calendar of R.O.C./Gregorian Calendar date and its corresponding Chinese Lunar Calendar date shown on the display screen of the electronic calendar, wherein the Chinese Lunar Calendar date is the 30th day of the second month of the year and this month is a long month represented by L (30 days per month)
Figure 3:
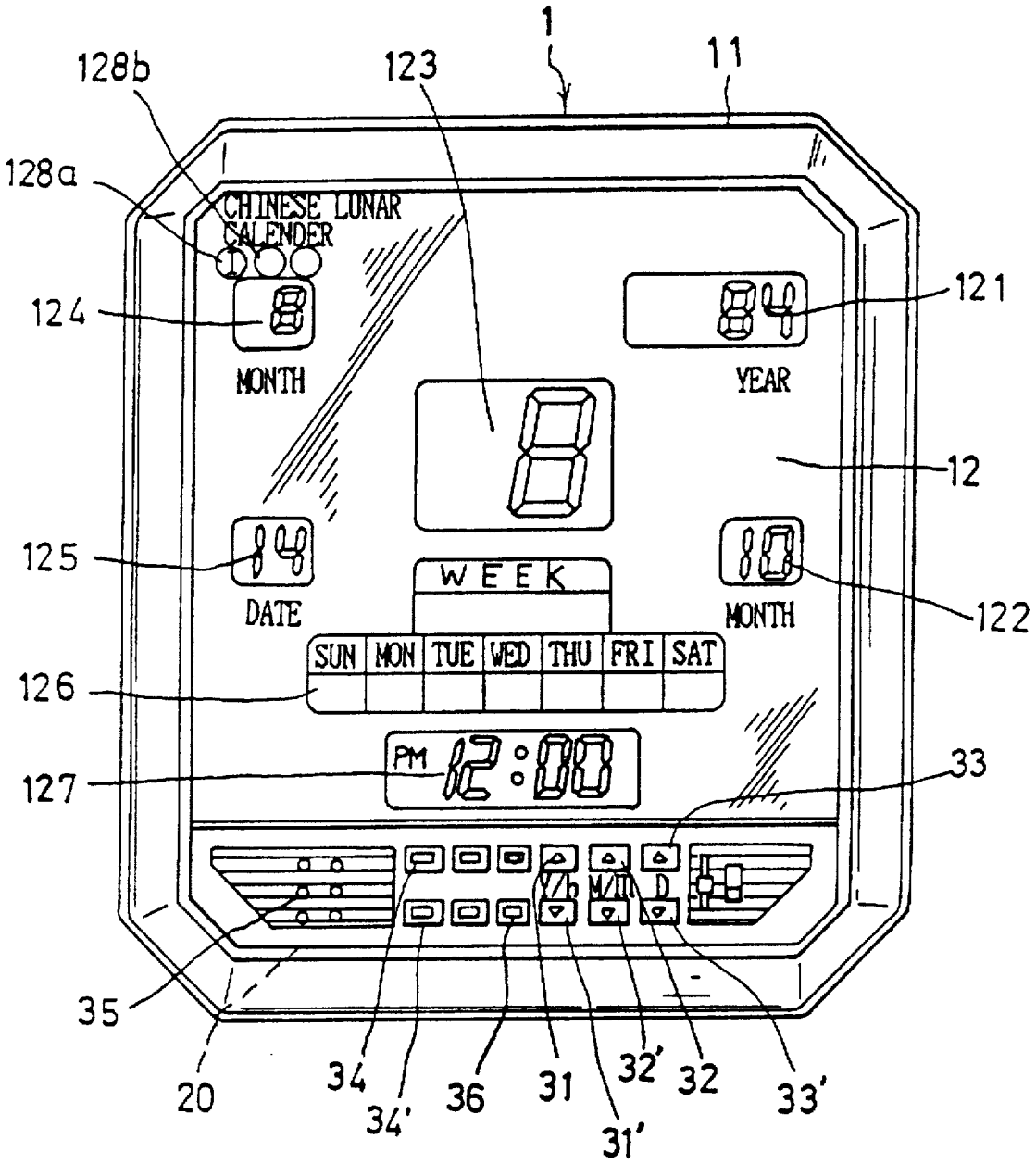
FIG. 3 illustrates the National Calendar of R.O.C./Gregorian Calendar date and its corresponding Chinese Lunar Calendar date shown on the display screen of the electronic calendar, wherein the Chinese Lunar Calendar date is 14th day of the intercalary month (represented by I) of the eighth month of the year and this month is a short month (29 days per month)

With reference to the drawings and in particular to FIGS. 1, 2, 3 and 4, the present invention can be used for conversion between National Calendar of R.O.C. (Republic of China)/Gregorian Calendar date and the Chinese Lunar Calendar date. The display screen will display both calendar formats on the screen of the electronic calendar(1) at the same time. This invention mainly comprises a main body (11) and a display screen (12). The display screen (12) consists of several display units: year for National Calendar of R.O.C./Gregorian Calendar(121), month for National Calendar of R.O.C./Gregorian Calendar(122), day for National Calendar of R.O.C./Gregorian Calendar, month for the Chinese Lunar Calendar (124), day for the Chinese Lunar Calendar (125), day of week (126), and time (127). These display units are made up of seven segment display units or LED (light emitting diode) The central processing unit (20) receives information from timing control unit (21) and the received information will be converted into one set of Gregorian calendar information and one set of the Chinese lunar calendar information. The converted information will be displayed on the corresponding display units on the display screen(12). A keypad control circuit (3) consists of several keys for entering the date information to the central processing unit(20) for converting the entered date to the corresponding Chinese Lunar Calendar date or National Calendar of R.O.C./Gregorian Calendar date. Both the entered and converted date will be displayed on the corresponding display units on the display screen (12). The user can use this invention to find out the corresponding Chinese Lunar Calendar date or National Calendar of R.O.C./Gregorian Calendar date in the past or future.

The keypad control circuit (3) of this invention consists of the following keys : two "YEAR/HOUR" keys (31,31') for increasing/decreasing the setting of YEAR display unit (121); two "MONTH/MINUTE" keys (32,32') for increasing/decreasing the setting of MONTH display unit (122); two "DAY" keys (33,33') for increasing/decreasing the setting of DAY display unit (123); an alarm pre-set key (34) is used for setting up multiple sets of alarm time, the alarm time will be stored in the memory of central processing unit (20), the audio integrated circuit will be triggered to broadcast music or Buddhist information through loudspeaker(35) when the information from time control circuit(21) is the same as the pre-set alarm time; one National Calendar of R.O.C./Gregorian Calendar switch over key (36) is used to switch the YEAR display unit (121) from one to another.

This invention complies to the tradition of the Chinese Lunar Calendar and has the indicators for indicating whether the month displayed is an intercalary month (128*a*) or a short month (29 days per month)(128*b*) or a long month (30 days per month)(128*c*).

When the electronic calendar is powered on, the current date in both the Chinese Lunar Calendar and Gregorian Calender format will be displayed on the display screen. As shown in FIG. 1, the date is Thursday, Apr. 18th of the 85th year of R.O.C., the corresponding Chinese Lunar Calendar date is the 1st day of the third month (this is a short month) of the year and the time is 12 o'clock. If the day value is decreased by pressing "DAY" key (33') to 17 on DAY display unit(123), the corresponding Chinese Lunar Calendar will be changed to the 30th day of the second month (this is long month) of the year, and the day of the week is changed to Wednesday instantly If "YEAR/HOUR" key (31'), "MONTH/MINUTE" key (32) and "DAY" key (33') are pressed to change the date to the 8th day of October of the 84th year of R.O.C., the corresponding Chinese Lunar Calendar will be changed to the 14th day of the intercalary month of the eighth month (short month) of the year. Similarly, the user can find out the Chinese Lunar Calendar date of desired National Calendar of R.O.C./Gregorian Calendar date instantly by pressing the appropriate keys and both the entered date and the corresponding Lunar Calendar date are displayed on the same display screen (12).

Figure 4:
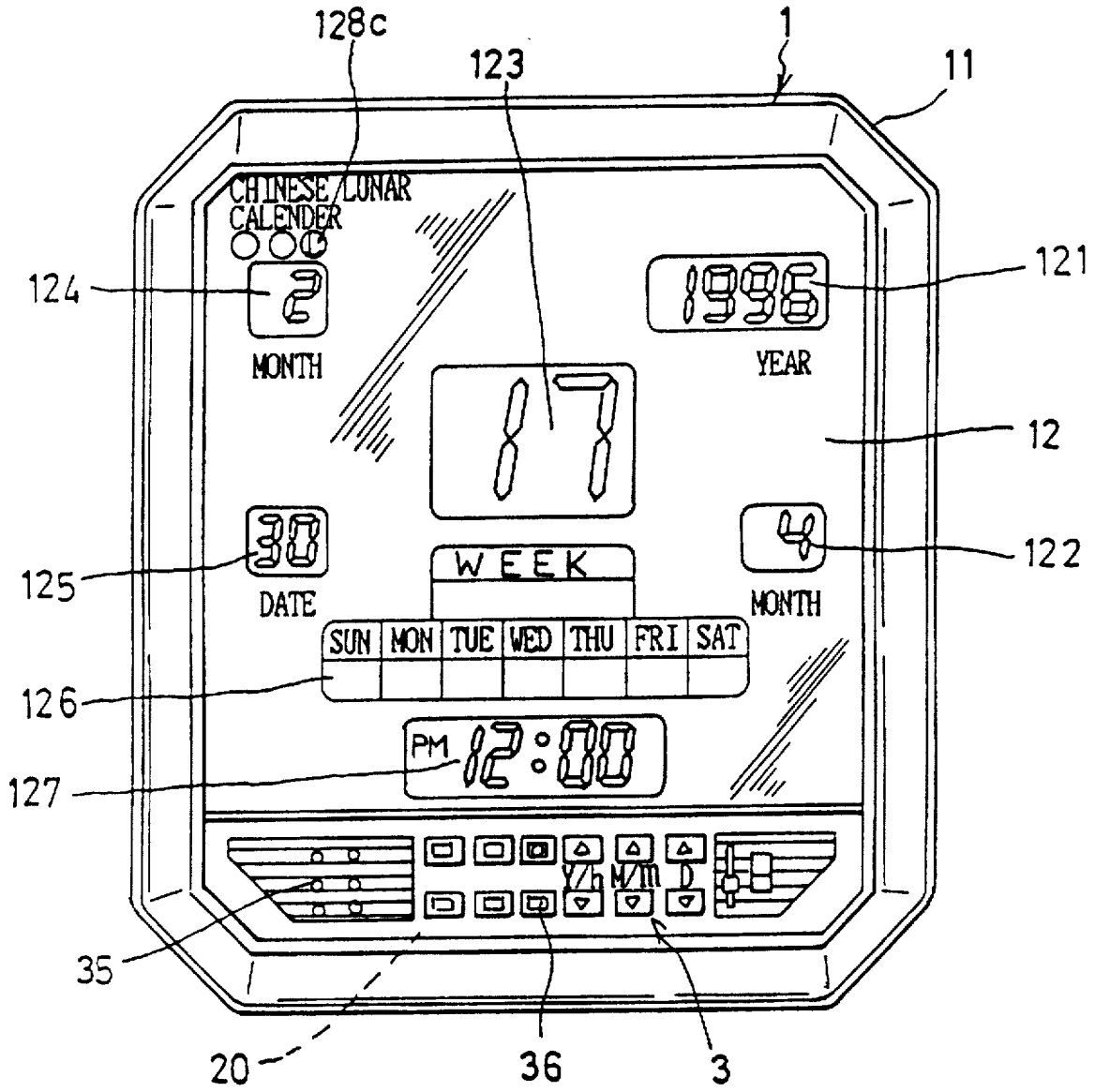
FIG. 4 illustrates the same day as shown in FIG. 2.

When the National Calendar of R.O.C./Gregorian Calendar change-over switch key (36) is pressed, the year display unit (121) be changed to reflect the desired calendar year. As shown in FIG. 4, the process for finding out the corresponding Chinese Lunar Calendar date from National Calendar of R.O.C. environment is the same as that used from Gregorian Calendar environment.

If the user wants to find out the corresponding National Calendar of R.O.C. date from the Chinese Lunar Calendar date, the "YEAR/HOUR" key (31,31'), "MONTH/MINUTE" key (32,32'), "DAY" key (31,31') are used to change the date of National Calendar portion till the corresponding Chinese Lunar Calendar date is the same as the desired Chinese Lunar Calendar date, then the National Calendar of R.O.C. date is the desired date. This electronic calendar can be used to find out the corresponding Chinese Lunar Calendar date from National Calendar of R.O.C. date or the reverse. RESET key (38) is pressed for returning back to normal operating environment after finished conversion of date from one calendar format to another calendar format, the electronic calendar will return back to normal operating environment automatically in case of no intervention for longer than 20 seconds.

The keypad control circuit (3) consists of two alarm type selection keys (34, 34'). Key 34 is used for pre-setting alarm type "1", which is a daily alarm, and multiple type "1" alarm can be pre-set i.e. after pressing key 34, "YEAR/HOUR" keys (33,33') and "MONTH/MINUTE" keys (32,32') are used to set up the first alarm to 6:30 am, the second alarm to 1:20 pm, the audio integrated circuit will be triggered to broadcast music or Buddhist information through loudspeaker(35) to notify the user of the arrival of pre-set time when the time of the timing control circuit (21) is the same as the pre-set alarm times. The alarm selection key 34' is used to pre-set alarm type "2", which type of alarm is used to pre-set a day of a year. The pre-set procedure is similar to that used for setting up alarm type "1" and the audio integrated circuit will be triggered to broadcast another type of audio information through loudspeaker(35) to notify the user of the arrival of the preset day when the date information of the timing control circuit (21) is the same as the pre-set date.

As this electronic calendar can display the date of National Calendar of R.O.C. and the corresponding date of the Chinese Lunar Calendar on the display screen (12) at the same time, it can be used to perform conversion between the Chinese Lunar Calendar date and of National Calendar of R.O.C./Gregorian Calendar date, and to support two types of alarm notifications (based on pre-set hour and minute and based on the pre-set date). It is obvious that this electronic calendar is superior to the commonly available electronic calendars.

Figure 5:
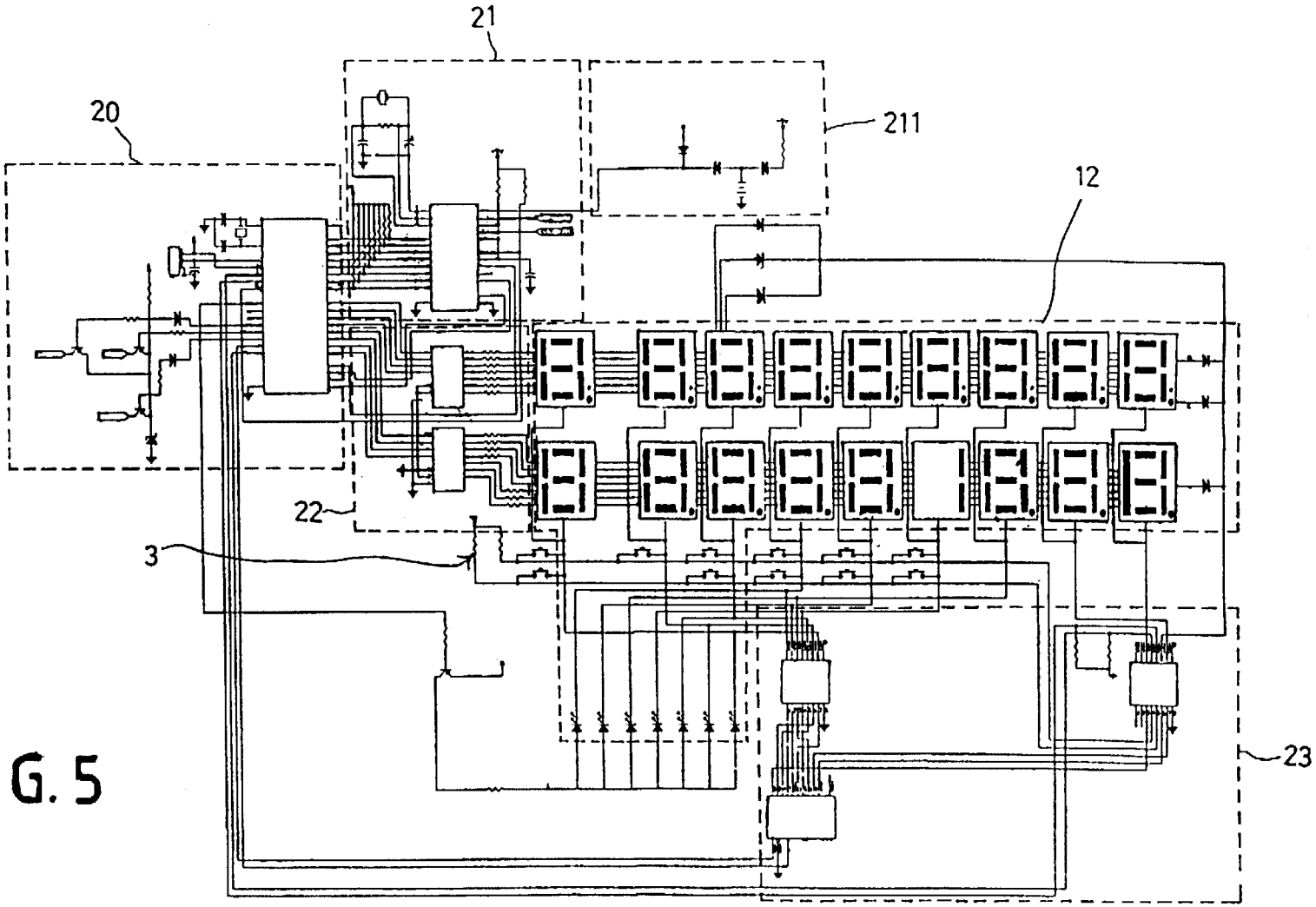
FIG. 5 shows the circuit diagram of the electronic calendar according to the present invention.

With reference to FIG. 5 showing the circuit diagram of this invention, the timing control circuit (21) sends timing information to the central processing unit (20) which will process the incoming information from timing control circuit (21) and send the output information to converter (22). Then, the converter (22) will convert the information from central processing unit (20) into display signal for the display units. The display signal from converter (22) will cooperate with the display/keypad scanner circuit (23) for displaying the information on the corresponding display units on the display screen (12). The the displayed information includes year, month and day of National Calendar of R.O.C/Gregorian Calendar, month and day of the Chinese Lunar Calendar, day of week, hour and minute. The central processing unit (20) will also receive key-in information from the keypad control circuit (3) and the received information will be processed to produce the corresponding Chinese Lunar Calendar date and National Calendar of R.O.C. date information. The information will be displayed on the corresponding display units on display screen (12) through the cooperation of converter (22) and display/keypad scanner circuit (23). An alarm notification may be pre-set by pressing the keys of keypad control circuit (3) and the pre-set alarm is stored in the memory of central processing unit (20). The audio integrated circuit will be triggered to broadcast a voice through loudspeaker (35) to notify user of the arrival of the pre-set time/date when the time/date information from timing control circuit matches with the pre-set alarm time/date.

Figure 6:
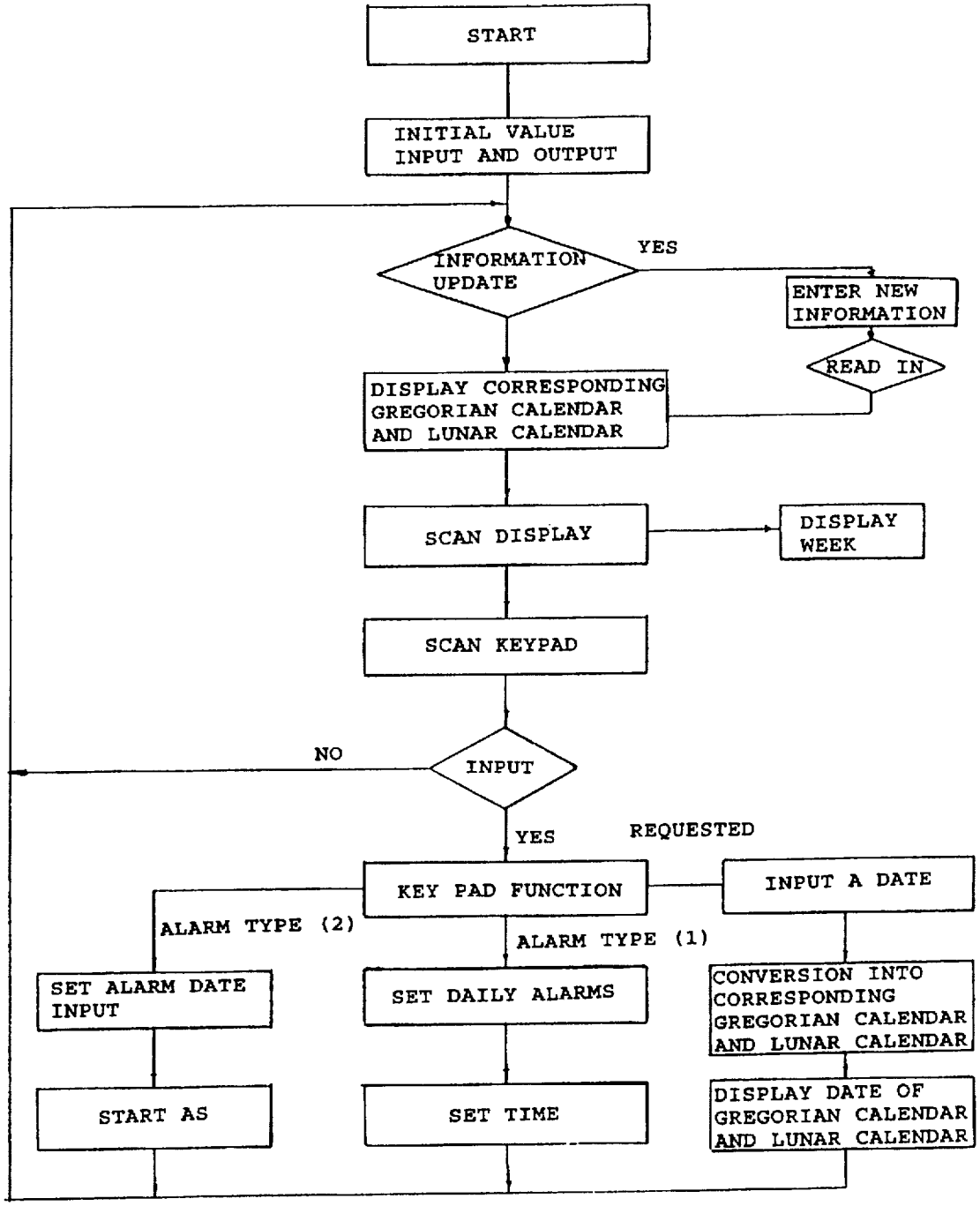
FIG. 6 shows the logic flow diagram of the electronic calendar according to the present invention.

Refering to FIG. 6, the logic flow of the present invention will be described as follows:

The calendar starts to run after power is switched on and the system will perform initial value input and output to decide if information is updated or not. If information update is true, enter new information, and if new information is read, then update the Chinese Lunar Calendar and National Calendar of R.O.C. information and the corresponding display information, update and scan the display units of display screen display units to reflect the entered new information, update the day of week information, scan the keypad for any input information If input: information is detected, then determine which function is requested. If the requested function is calendar date conversion, then convert the information to corresponding National Calendar of R.O.C. and the Chinese Lunar Calendar information and send the converted information to the corresponding display units on the display screen. If the requested function is setting of alarm type "1", allow the pre-setting of multiple daily alarms. When the time of timing control circuit is the same as the pre-set time, an audio integrated circuit will be triggered to broadcast voice information through loudspeaker. If the requested function is setting of alarm type "2", allow the date alarm setting. When the date information of timing control circuit is the same as the pre-set date, the audio integrated circuit will be triggered to broadcast voice information through loudspeaker to notify the user.

A battery circuit (211) is connected to timing control circuit (21) for providing power supply to the timing control circuit (21) after the power supply of the electronic calendar is discontinued, so that the normal operation of timing control circuit (21) will not be interrupted.

The keypad control circuit (3) consists of an alarm reset key (37) for resetting the signal for triggering the loudspeaker (35), so that the audio alarm is interrupted (cleared).

In conclusion, the present invention has the following advantages:

1. This invention can display the date of the Chinese Lunar Calendar, date of National Calendar of R.O.C./Gregorian Calendar, year, day of week and time on the same display screen at the same time.
2. This invention provides instant date conversion between date of Lunar Calendar and date of National Calendar of R.O.C./Gregorian Calendar and both the date for conversion and the converted date are displayed on the same display screen at the same time, so that the user can find out; the National Calendar of R.O.C./Gregorian Calendar date and its corresponding Lunar Calendar date without the need of the switch-over of display screen.
3. This invention provides multiple calendar information (the Chinese Lunar Calendar, National Calendar of R.O.C. and Gregorian Calendar) used for Chinese custom. It can be used for years and as replacement of the use of printed paper calendar, so that less paper is used and better environment protection is achieved.
4. This invention supports the pre-set of multiple time and date alarm notification. When the pre-set time/date is arrived, an audio notification is created to notify the user. This feature is quite suitable for notifying the user of the important date, activity, . . . etc.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. An electronic calendar for finding out a Chinese Lunar Calendar date corresponding to a Gregorian Calendar/National Calendar of R.O.C. date instantly and vice versa, comprising:

a system box;

a keypad control circuit for controlling entering date information to a central processing unit;

a timing control circuit which will provide time and date information to said central processing unit continuously, said central processing unit converting time and date information to Gregorian Calendar date/National Calendar of R.O.C. date and Lunar Calendar date information for displaying on display units on display screen;

a display screen consisting of display units for displaying the value of year, month and day for Lunar Calendar and Gregorian. Calendar/National Calendar of R.O.C., day of week, time of day, intercalary month, long month and short month informations for Lunar Calendar;

a memory for storing several sets of pre-set date alarms and daily alarms, alarm information being entered from said keypad control circuit, the central processing unit using said alarm information to control a loudspeaker for notifying a user;

a central processing unit for:

(a) processing information from timing control circuit and keypad control circuit;

(b) converting the Gregorian Calendar date/National Calendar of R.O.C. date into Lunar Calendar date, the converted Lunar Calendar date and Gregorian Calendar date/National Calendar of R.O.C. date being displayed on the display screen at the same time and showing whether the month of Lunar Calendar is an intercalary month, a short month or a long month, (c) notifying a user when the pre-set alarm time and alarm date is arrived, (d) converting timing information into the display information for displaying on the various display units on the display screen.

2. The electronic calendar as claimed in claim 1, wherein said keypad control circuit can be used for entering the pre-set alarm time/date and the entered alarm time/date is stored in the memory of central processing unit so that when the time/date information of the timing control circuit is the same as the pre-set alarm time/date, the central processing unit will trigger an audio integrated circuit and then an audio alarm created through a loudspeaker for notifying users for the arrival of the pre-set Lunar Calendar/National Calendar of R.O.C. date/time.

3. The electronic calender as claimed in claim 1, wherein the pre-set date/time alarms are driven by an audio integrated circuit, the hourly alarm is handled by the central processing unit and different type of sound is used for differentiating the hourly alarm from the pre-set date/time alarms.

* * * * *